US009743476B2

(12) United States Patent
Yoneoka et al.

(10) Patent No.: US 9,743,476 B2
(45) Date of Patent: Aug. 22, 2017

(54) LIGHT SOURCE CONTROL DEVICE AND LIGHT SOURCE CONTROL METHOD

(71) Applicant: MITSUBISHI ELECTRIC CORPORATION, Tokyo (JP)

(72) Inventors: Isao Yoneoka, Tokyo (JP); Yoshinori Asamura, Tokyo (JP); Zenkou Yamamoto, Tokyo (JP); Haruhisa Inoue, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/721,743

(22) Filed: May 26, 2015

(65) Prior Publication Data

US 2015/0373803 A1 Dec. 24, 2015

(30) Foreign Application Priority Data

Jun. 23, 2014 (JP) ..... 2014-128009

(51) Int. Cl.
*H05B 37/02* (2006.01)
*H05B 33/08* (2006.01)

(52) U.S. Cl.
CPC ..... *H05B 33/0848* (2013.01); *H05B 33/0827* (2013.01)

(58) Field of Classification Search
CPC .... H05B 37/02; H05B 37/03; H05B 33/0827; H05B 33/0848; H05B 33/0875; H05B 33/0884; H05B 37/032
USPC ..... 315/307–308, 291, 297, 318, 294, 185 R
See application file for complete search history.

(56) References Cited

U.S. PATENT DOCUMENTS

| | | | | |
|---|---|---|---|---|
| 6,351,079 | B1 | 2/2002 | Willis | |
| 7,557,524 | B2 * | 7/2009 | Chevalier | H05B 33/0803 250/214 AL |
| 7,876,103 | B2 | 1/2011 | Mihai et al. | |
| 9,401,600 | B2 | 7/2016 | Zhang et al. | |
| 2002/0030455 | A1 * | 3/2002 | Ghanem | G01R 31/2653 315/291 |
| 2004/0080273 | A1 * | 4/2004 | Ito | H05B 33/0815 315/77 |
| 2012/0050696 | A1 * | 3/2012 | Yanase | G03B 21/2033 353/85 |
| 2012/0074845 | A1 * | 3/2012 | Aoki | H05B 33/0845 315/119 |

(Continued)

FOREIGN PATENT DOCUMENTS

| | | | |
|---|---|---|---|
| CN | 103249195 | A | 8/2013 |
| CN | 203352867 | U | 12/2013 |

(Continued)

*Primary Examiner* — Jimmy Vu
*Assistant Examiner* — Henry Luong
(74) *Attorney, Agent, or Firm* — Birch, Stewart, Kolasch & Birch, LLP

(57) ABSTRACT

A light source control device includes a constant-current circuit that collectively supplies a current to a plurality of LEDs, a current detection circuit that divides the plurality of LEDs into groups and detects a current amount of a current supplied to each of the groups, and a microcomputer that detects an open fault in the LEDs on the basis of a ratio of the current amount in each of the groups and controls a current supplied from the constant-current circuit to be reduced in a case where an open fault is detected in the LEDs.

5 Claims, 6 Drawing Sheets

(56) References Cited

U.S. PATENT DOCUMENTS

| | | | | |
|---|---|---|---|---|
| 2012/0074856 | A1 | 3/2012 | Takata et al. | |
| 2013/0088169 | A1* | 4/2013 | Ge | H05B 33/0827 315/297 |
| 2013/0241410 | A1 | 9/2013 | Sakuma | |
| 2013/0241417 | A1 | 9/2013 | Sakuma | |
| 2014/0097761 | A1 | 4/2014 | Chen et al. | |
| 2015/0173133 | A1* | 6/2015 | Seki | H05B 33/0818 315/185 R |
| 2016/0064925 | A1 | 3/2016 | Zhang et al. | |

FOREIGN PATENT DOCUMENTS

| | | | |
|---|---|---|---|
| JP | 2007-95391 | A | 4/2007 |
| JP | 2007-96113 | A | 4/2007 |
| JP | 2008-305941 | A | 12/2008 |
| JP | 2013-189070 | A | 9/2013 |
| JP | 2013-189071 | A | 9/2013 |
| RU | 2378708 | C1 | 1/2010 |
| WO | WO 2014/055847 | A2 | 4/2014 |

* cited by examiner

FIG. 3

| DDn | Ifn(A) |
|---|---|
| 0 | 0 |
| 5 | 0.5 |
| 10 | 1.0 |
| 15 | 1.5 |
| 20 | 2.0 |
| 25 | 2.5 |
| 30 | 3.0 |
| 35 | 3.5 |
| ⋮ | ⋮ |
| 75 | 7.5 |
| 80 | 8.0 |
| ⋮ | ⋮ |
| 125 | 12.5 |
| 130 | 13.0 |
| 135 | 13.5 |
| 140 | 14.0 |
| 145 | 14.5 |
| 150 | 15.0 |
| 155 | 15.5 |
| 160 | 16.0 |
| 165 | 16.5 |
| ⋮ | ⋮ |
| 250 | 25.0 |

LIGHT SOURCE CONTROL DEVICE AND LIGHT SOURCE CONTROL METHOD

BACKGROUND OF THE INVENTION

Field of the Invention

The present invention relates to a light source control device and a light source control method in a case where a plurality of light sources, such as light emitting diodes (hereinafter referred to as "LEDs") or lasers, are used.

Description of the Background Art

In recent times, as light sources of projection video display devices, an aggregation of a plurality of LEDs connected in parallel have been developed to be used. The advantage of the parallel-connected LEDs is that the large number of LEDs can be driven at low voltage and that light sources in high luminance can be obtained by lighting the plurality of LEDs. Thus, in comparison to devices including conventional lamp light sources, the devices including the light sources formed of the plurality of LEDs connected in parallel can suppress power consumption of the whole devices.

The LEDs have been known that vary in luminance according to a drive current supplied, and a user sets the drive current through a control device such as a microcomputer to obtain desired luminance. A method for setting the drive current from the control device such as the microcomputer to adjust the luminance of the LED light sources is, for example, technologies disclosed in Japanese Patent Application Laid-Open No. 2007-95391 and Japanese Patent Application Laid-Open No. 2007-96113.

The plurality of LED light sources connected in parallel have the advantage that a video display can continue because even if an open fault causes an unlit LED, the other normal LEDs in which no fault occurs light up. However, a fault cannot be detected because when the light goes out due to an open fault, the other normal LEDs in which no fault occurs continue to light up. A rated current or more may flow through the other normal LEDs according to an amount of a drive current being set. This may cause a further fault, and faults may occur in all of the LEDs.

SUMMARY OF THE INVENTION

It is an object of the present invention to provide a light source control device capable of detecting a fault in light sources due to an open fault and preventing an excessive current from flowing through the other normal light sources in which no fault occurs and to provide a light source control method.

A light source control device according to the present invention controls a plurality of light sources connected in parallel. The light source control device includes a current supply unit that collectively supplies a current to the plurality of light sources, a current detector that divides the plurality of light sources into groups and detects a current amount of a current supplied to each of the groups, a fault detector that detects an open fault in the light sources on the basis of a ratio of the current amount in each of the groups, and a controller that controls a current supplied from the current supply unit to be reduced in a case where the fault detector detects an open fault in the light sources.

A light source control method according to the present invention is performed by a light source control device that includes a current supply unit collectively supplying a current to a plurality of light sources connected in parallel and controls the plurality of light sources. The light source control method includes dividing the plurality of light sources into groups and detecting a current amount of a current supplied to each of the groups, detecting an open fault in the light sources on the basis of a ratio of the current amount in each of the groups, and controlling a current supplied from the current supply unit to be reduced in a case where an open fault is detected in the light sources.

The light source control device includes the current supply unit that collectively supplies a current to the plurality of light sources, the current detector that divides the plurality of light sources into groups and detects a current amount of a current supplied to each of the groups, the fault detector that detects an open fault in the light sources on the basis of a ratio of the current amount in each of the groups, and the controller that controls a current supplied from the current supply unit to be reduced in a case where the fault detector detects an open fault in the light sources. Therefore, the fault in the light sources due to the open fault can be detected, and the excessive current can be prevented from flowing through the other normal light sources in which no fault occurs.

These and other objects, features, aspects and advantages of the present invention will become more apparent from the following detailed description of the present invention when taken in conjunction with the accompanying drawings.

BRIEF DESCRIPTION OF THE DRAWINGS

FIG. 3 is a chart showing the characteristics of the current detection circuits;

DESCRIPTION OF THE PREFERRED EMBODIMENT

Comparative Example

Figure 6:
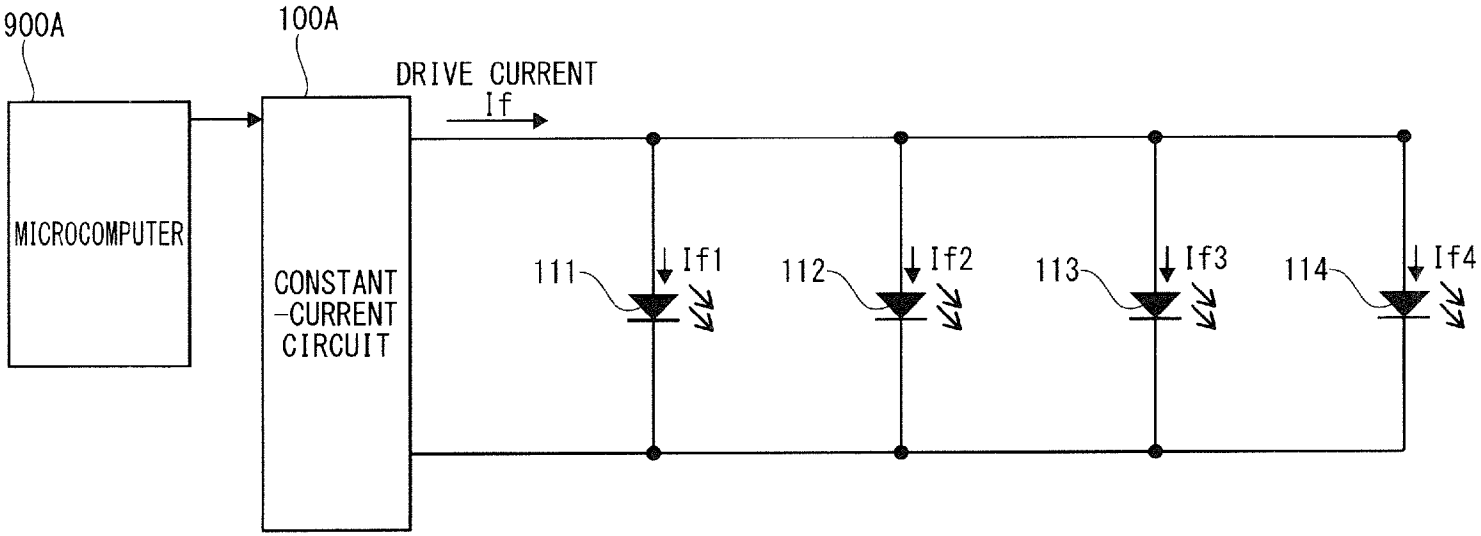
FIG. 6 is a block diagram showing a configuration of a light source control device according to a comparative example.

First, a light source control device according to a comparative example is described. FIG. 6 is a diagram showing a configuration of the light source control device according to the comparative example. The light source control device according to the comparative example controls LEDs 111, 112, 113, 114 being a plurality of light sources connected in parallel.

As shown in FIG. 6, the light source control device according to the comparative example includes a microcomputer 900A, a constant-current circuit 100A, and the LEDs 111, 112, 113, 114. The LEDs 111, 112, 113, 114 are electrically connected in parallel.

The microcomputer 900A is, for example, a microcomputer such as a micro processing unit (MPU). The constant-current circuit 100A supplies a predetermined drive current If to the LEDs 111, 112, 113, 114 in accordance with control by the microcomputer 900A. In other words, the constant-current circuit 100A supplies a current to the LEDs 111, 112, 113, 114. Thus, the LEDs 111, 112, 113, 114 each emit light.

LEDs vary in luminance of emitted light according to a current supplied. The light source control device according to the comparative example has a configuration in which a user uses a user interface or the like to set the drive current If through the microcomputer 900A and obtains desired luminance.

However, the configuration of the light source control device according to the comparative example fails to detect a fault because when light goes out due to an open fault, the normal LEDs in which no fault occurs continue to light up. A rated current or more may flow through the other normal LEDs according to an amount of a drive current being set. This may cause a further fault, and faults may occur in all of the LEDs. Thus, a preferred embodiment below solves the problems described in the comparative example.

Preferred Embodiment

Figure 1:
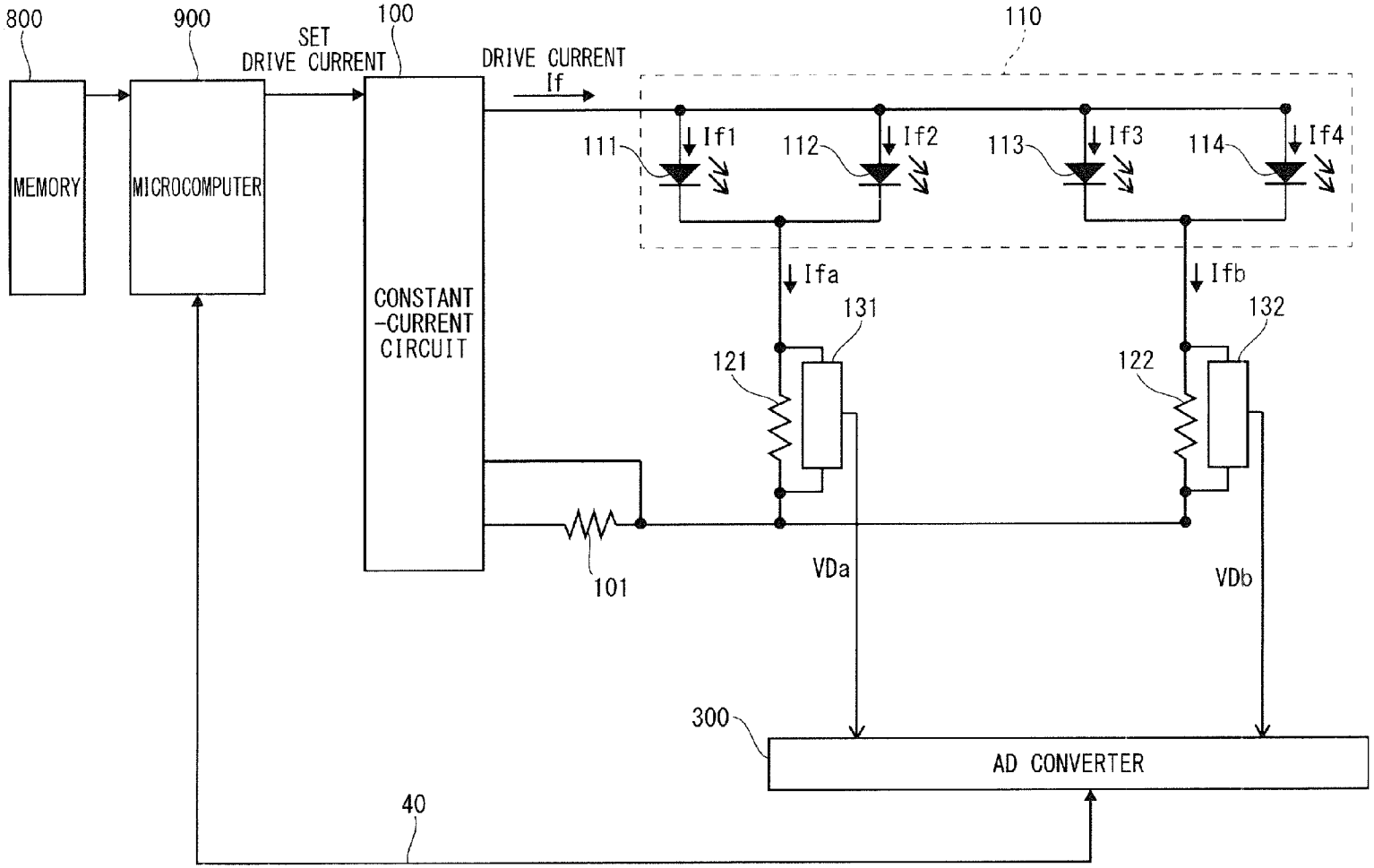
FIG. 1 is a block diagram showing a configuration of a light source control device according to a preferred embodiment.
Figure 2:
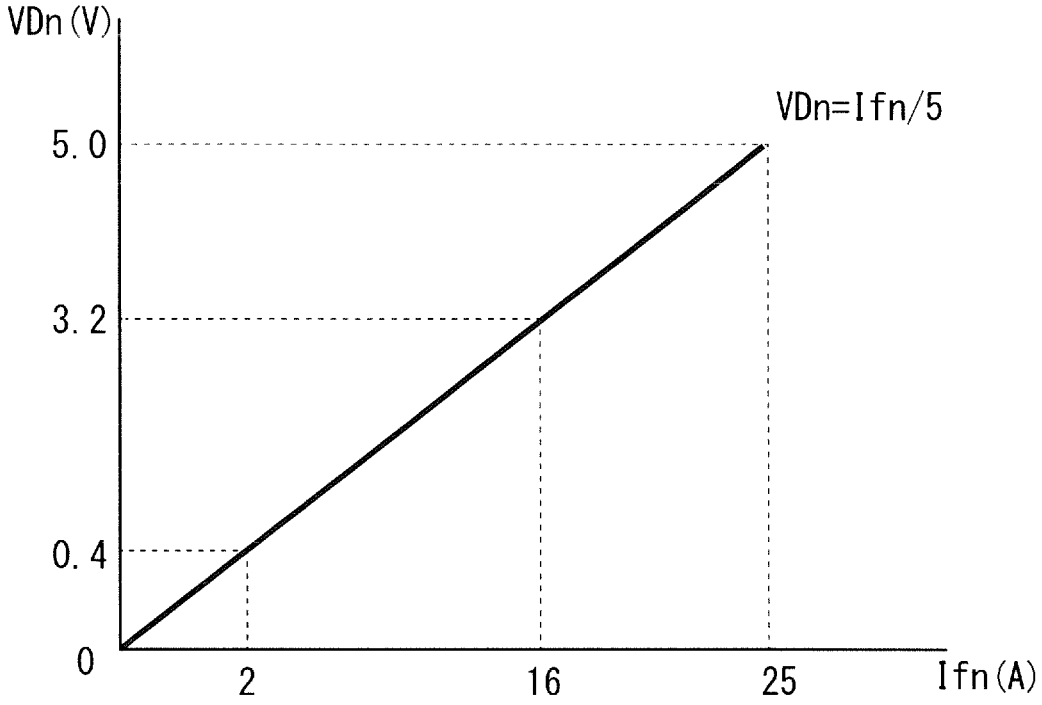
FIG. 2 is a graph showing characteristics of current detection circuits.

A preferred embodiment of the present invention is described below with reference to diagrams. FIG. 1 is a block diagram showing a configuration of a light source control device according to the preferred embodiment, FIG. 2 is a graph showing characteristics of current detection circuits 131, 132, and FIG. 3 is a chart (conversion table) showing the characteristics of the current detection circuits 131, 132.

As shown in FIG. 1, the light source control device controls LEDs 111, 112, 113, 114 being a plurality of light sources connected in parallel. The light source control device includes a microcomputer 900, a memory 800, a constant-current circuit 100, a detection resistor 101, the LEDs 111, 112, 113, 114, detection resistors 121, 122, the current detection circuits 131, 132, and an AD converter 300.

The microcomputer 900 is, for example, a microcomputer such as the MPU. The microcomputer 900 controls the constant-current circuit 100, includes a timer function or a clock function for conduction time of the light source control device, and includes a detection function of fault information of LEDs described below. Herein, the microcomputer 900 corresponds to a controller and a fault detector. The memory 800 (storage unit) stores fault information of the LEDs. The fault information is described below.

The constant-current circuit 100 (current supply unit) collectively supplies the drive current If to the plurality of LEDs. More specifically, the microcomputer 900 controls the drive current If supplied from the constant-current circuit 100 on the basis of fault information that is a detection result of the current detection circuits 131, 132. The constant-current circuit 100 supplies the predetermined drive current If for lighting the LEDs in accordance with the control by the microcomputer 900, and the constant-current circuit 100 can change the amount of the current supply on the basis of the fault information. The constant-current circuit 100 supplies a constant current by controlling a voltage detected by the detection resistor 101 constant.

The LEDs 111, 112, 113, 114 emit light of the same predetermined color (for example, red) and have all of the same specifications and characteristics, such as luminance of emitted light according to the drive current If supplied, a forward drop voltage (hereinafter referred to as "Vf"), and a rated current. The four LEDs 111, 112, 113, 114 are collectively regarded as one LED light source aggregation 110. In addition, it is described assuming that the LEDs 111, 112 belong to an LED group A and the LEDs 113, 114 belong to an LED group B.

The detection resistors 121, 122 respectively detect a current amount of a drive current supplied to the LED group A to which the LEDs 111, 112 belong and a current amount of a drive current supplied to the LED group B to which the LEDs 113, 114 belong. The detection resistors 121, 122 have the same specifications and characteristics.

The current detection circuits 131, 132 (current detectors) respectively detect a current amount of a drive current flowing through the detection resistor 121 and a current amount of a drive current flowing through the detection resistor 122, to thereby detect current amounts of drive currents supplied to each of the LED groups A, B, the detection resistors 121, 122 being connected to the current detection circuits 131, 132. The current detection circuits 131, 132 respectively output current detection signals VDa, VDb at voltage levels corresponding to the current amounts of currents flowing through the detection resistors 121, 122. The current detection circuits 131, 132 have the same specifications and characteristics.

The AD converter 300 converts the voltage levels of the current detection signals VDa, VDb to predetermined digital values on the basis of a predetermined rule. The AD converter 300 follows a request from the microcomputer 900 and transmits the converted digital values to the microcomputer 900.

Next, operations of the constant-current circuit 100 are described. With the configuration as described above, Math 1 and Math 2 hold true for the drive current If and drive currents If1, If2, If3, If4 that respectively flow through the LEDs 111, 112, 113, 114.

$$If = If1 + If2 + If3 + If4 \quad \text{[Math 1]}$$

$$If1 = If2 = If3 = If4 \quad \text{[Math 2]}$$

For example, when rated currents of the LEDs 111, 112, 113, 114 are in a range of 1 A to 8 A, the constant-current circuit 100 is configured to be capable of supplying the whole drive current If=a range of 4 A to 32 A. Moreover, the microcomputer 900 is programmed so as to be able to change the setting of the drive current If in the range of 4 A to 32 A. The LEDs 111, 112, 113, 114 vary in luminance according to the drive current If supplied as described above, so that a user transmits a command to the microcomputer 900 and adjusts a set value of the drive current If to obtain desired luminance.

Next, the current detection circuits 131, 132 are described. The detection resistors 121, 122 connected in parallel to each other are respectively supplied with the same current as the drive currents If1+If2 flowing through the LED group A to which the LEDs 111, 112 belong and the same current as the drive currents If3+If4 flowing through the LED group B to which the LEDs 113, 114 belong, as shown in Math 3 and Math 4.

$$Ifa = If1 + If2 \quad \text{[Math 3]}$$

$$Ifb = If3 + If4 \quad \text{[Math 4]}$$

The current detection circuits 131, 132 have a function of integrating pulse waveforms after conversion from currents to voltages, following characteristics based on Math 5, and each converting the currents to the current detection signals VDa, VDb of 0 V to 5V.

$$VDn = Ifn/5 (n = a, b) \quad \text{[Math 5]}$$

Therefore, as shown in FIG. 2, the current detection circuits 131, 132 output VDa, VDb being 0 V for 0 A, 0.4 V for 2 A, and 3.2 V for 16 A to the AD converter 300.

Next, operations of the AD converter 300 are described. The AD converter 300 includes two channels for converting signals to be input to digital data, and each of the channels converts the voltage levels of VDa, VDb to digital data DDn (n=a, b) in a range of 0 to 250 based on a conversion expression in Math 6.

$$DDn=250\times(VDn/5)(n=a,b) \quad \text{[Math 6]}$$

Furthermore, the AD converter 300 and the microcomputer 900 are connected with, for example, an IIC bus 40. When the AD converter 300 receives a request from the microcomputer 900 through the IIC bus 40, the AD converter 300 is configured to transmit the converted digital data DDa, DDb through the IIC bus 40. In addition, Math 7 is derived from Math 5 and Math 6.

$$Ifn=DDn\times(5\times5)/250(n=a,b) \quad \text{[Math 7]}$$

The microcomputer 900 includes a memory (not shown), and the memory of the microcomputer 900 stores the conversion table shown in FIG. 3 based on the calculation result in Math 7. The microcomputer 900 can measure current amounts of a drive current Ifa flowing through the LED group A to which the LEDs 111, 112 belong and a drive current Ifb flowing through the LED group B to which the LEDs 113, 114 belong, on the basis of values of the digital data DDa, DDb.

Next, actual operations in the light source control device are described. First, the microcomputer 900 sets a drive current If in the constant-current circuit 100 and lights the LEDs 111, 112, 113, 114 in the luminance required by a user. Herein, it is assumed that the whole drive current If=24 A, and it is described assuming that drive currents If1 to If4 for each of the LEDs=24÷4=6 A.

The microcomputer 900 measures drive currents flowing through the LEDs 111, 112, 113, 114 by observing the digital data DDa, DDb from the AD converter 300 through the IIC bus 40 at regular intervals.

For example, when an open fault occurs in the LED 111, a drive current that 24÷3=8 A is equally supplied to each of the LEDs 112, 113, 114, so that measured values of current amounts of drive currents flowing through the LED groups A, B on the basis of the conversion table in FIG. 3 are shown as follows.

DDa: measured value 80→Ifa=8 A

DDb: measured value 160→Ifb=16 A

When a fault occurs in one of the LEDs, the current amount of the drive current Ifa supplied to the LED group A is not equal to the current amount of the drive current Ifb supplied to the LED group B, thereby reducing the current amount of the LED group including the LED in which the fault occurs. When the LED group A and the LED group B are not equal in the current amount, it is determined that an open fault occurs in the LEDs. In this case, the microcomputer 900 determines that the open fault occurs in one of the LEDs in the LED group A because a current ratio of the drive current Ifa of the LED group A to the drive current Ifb of the LED group B is 1:2, and the microcomputer 900 then stores, in the memory 800, fault information indicating that the open fault occurs in one of the LEDs belongs to the LED group A and the occurrence time of the fault.

Here, the fault information is information indicating the LED in which the open fault is detected, and more specifically, information indicating how many LEDs in which open faults occur belong to each of the LED groups A, B.

Next, the microcomputer 900 calculates a current limit value of the drive current If. The current limit value for one of the LEDs in which an open fault occurs is 8 A×3=24 A, and the drive current If of 24 A before the fault is the current limit value or less, so that the three remaining LEDs 112, 113, 114 are supplied with the drive current that 24 3=8 A, whereby the LEDs 112, 113, 114 light up in the same luminance as that before the fault.

Then, operations in a state where an open fault occurs in one of the LEDs, and additionally, one more open fault occurs therein are described. For example, it is assumed that an open fault occurs in the LED 111 and the microcomputer 900 determines that the open fault occurs in one of the LEDs belonging to the LED group A, and subsequently, an open fault occurs in the LED 114. A drive current that 24÷2=12 A is equally supplied to the remaining LEDs 112, 113 in the normal state, so that measured values of the drive currents flowing through the LED groups A, B on the basis of the conversion table in FIG. 3 are shown as follows.

DDa: measured value 120→Ifa=12 A

DDb: measured value 120→Ifb=12 A

A current ratio of Ifa to Ifb is 1:1 and the memory 800 includes the history of the fault information indicating that the open fault occurs in one of the LEDs belonging to the LED group A, so that the microcomputer 900 determines that the open fault occurs in one of the LEDs in the LED group B and stores, in the memory 800, the fault information indicating that the open fault occurs in one of the LEDs belonging to the LED group B and the occurrence time of the fault.

Next, the microcomputer 900 calculates the current limit value of the drive current If. A current limit value when two of the LEDs are faulty is 8 A×2=16 A, and the drive current If of 24 A before the fault thus exceeds the current limit value of 16 A. Thus, the microcomputer 900 sets the drive current If as 16 A being the current limit value and makes a drive current to be a set value that does not exceed a maximum rating of the LEDs such that 16÷2=8 A for each of the two remaining LEDs 112, 113. In other words, the microcomputer 900 is programmed such that a current amount of a drive current supplied to each of the LEDs on the basis of the number of faulty LEDs does not exceed the maximum rating.

Figure 4:
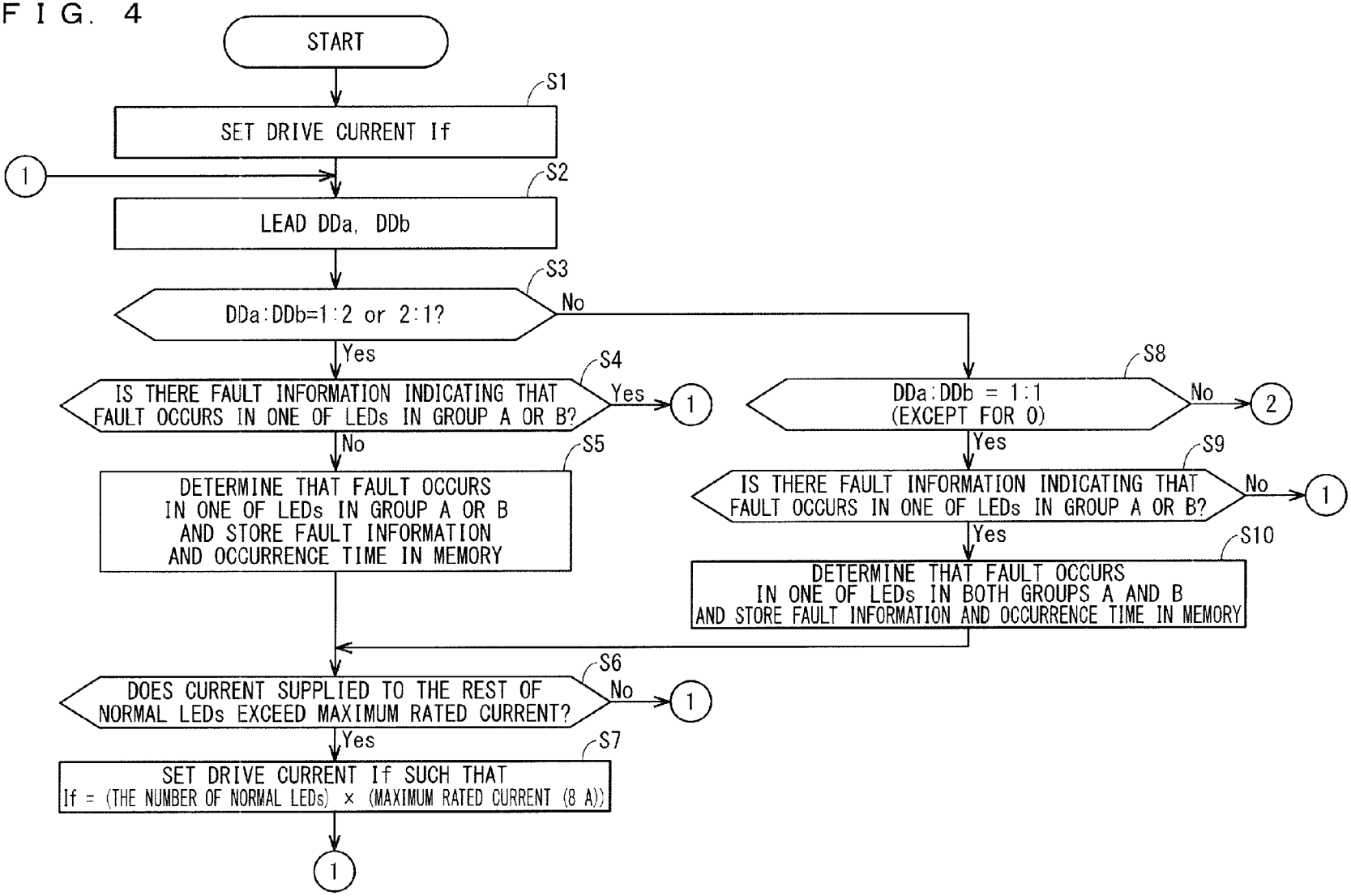
FIG. 4 is part of a flow chart of an LED drive current control.
Figure 5:
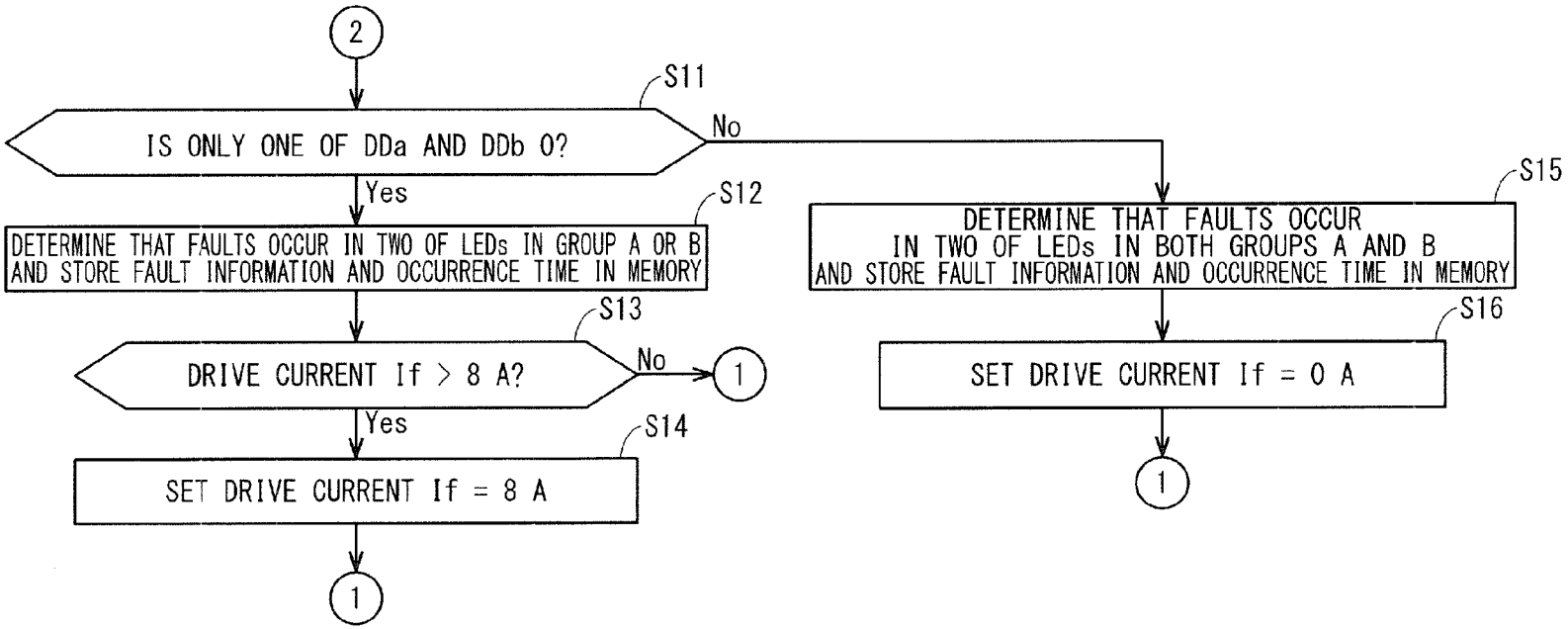
FIG. 5 is the rest of the flow chart of the LED drive current control.

Next, an LED drive current control performed by the microcomputer 900 is described with reference to FIGS. 4 and 5. FIG. 4 is part of a flow chart of the LED drive current control, and FIG. 5 is the rest of the flow chart of the LED drive current control.

The LED drive current control is continuous control during the operation of the light source control device. When a user activates the light source control device, first, the microcomputer 900 sets a drive current If (Step S1). The details of the setting of the drive current If upon the activation are described below.

Next, the microcomputer 900 reads DDa, DDb transmitted from the AD converter 300 (Step S2) and refers fault information stored in the memory 800, to thereby determine whether each of the LEDs is normal or faulty due to an open fault.

When detecting DDa=0 (Ifa=0 A) or DDb=0 (Ifb=0 A) (No in Step S3, No in Step S8, and Yes in Step S11), the microcomputer 900 determines that open faults occur in two of the LEDs belonging to the LED group A, or open faults occur in two of the LEDs belonging to the LED group B, and stores the fault information and the occurrence time of the faults in the memory 800 (Step S12). When the microcomputer 900 determines that a current amount of the drive current If being currently set is greater than 8 A (Yes in Step S13), fault detection cannot be performed by the ratio of DDa to DDb in this case, so that the process returns to Step S2 after the maximum rated current of 8 A of one LED is set as a current limit value (Step S14).

When detecting DDa=0 (Ifa=0 A) and DDb=0 (Ifb=0 A) (No in Step S11), the microcomputer 900 determines that open faults occur in two of the LEDs in both of the LED groups A, B, and stores the fault information and the occurrence time of the faults in the memory 800 (Step S15). The microcomputer 900 sets the drive current If as 0 A being a current limit value for protecting a circuit to stop the supply of the drive current If (Step S16), and subsequently, the process returns to Step S2.

When the microcomputer 900 determines that DDa:DDb=1:2 or 2:1 (Yes in Step S3) and fault information indicating that an open fault occurs in one of the LEDs belonging to the LED group A or in one of the LEDs belonging to the LED group B is stored in the memory 800 (Yes in Step S4), the process returns to Step S2.

On the other hand, when fault information indicating that an open fault occurs in one of the LEDs belonging to the LED group A or in one of the LEDs belonging to the LED group B is not stored in the memory 800 (No in Step S4), the microcomputer 900 determines that the open fault occurs in one of the LEDs belonging to the LED group A or in one of the LEDs belonging to the LED group B and stores the fault information and the occurrence time of the fault in the memory 800 (Step S5).

Next, when the microcomputer 900 determines that a drive current supplied to the other normal LEDs exceeds the maximum rated current (Yes in Step S6), it is assumed that the drive current If=the number of the normal LEDs×the maximum rated current (8 A), and the process returns to Step S2 after the drive current If is set as a current limit value (Step S7).

For No in Step S3, when DDa:DDb=1:1 (except for 0) (Yes in Step S8), the microcomputer 900 determines whether fault information indicating that an open fault occurs in one of the LEDs belonging to the LED group A or in one of the LEDs belonging to the LED group B is stored in the memory 800 (Step S9). When the fault information indicating that the open fault occurs in one of the LEDs belonging to the LED group A or in one of the LEDs belonging to the LED group B is stored in the memory 800 (Yes in Step S9), the microcomputer 900 determines that the open faults occur in one of the LEDs belonging to the LED group A and in one of the LEDs belonging to the LED group B and stores the fault information and the occurrence time of the faults in the memory 800 (Step S10). Next, the microcomputer 900 shifts the process to Step S5 and repeats the process as described above.

When fault information indicating that an open fault occurs in one of the LEDs belonging to the LED group A or in one of the LEDs belonging to the LED group B is not stored in the memory 800 (No in Step S9), the microcomputer 900 returns the process to Step S2. Here, when the LED is replaced for repair, the microcomputer 900 stores the replacement time of the LED in the memory 800. The microcomputer 900 determines that the fault information before the replacement time is invalid and sets the drive current If of 32 A that is a maximum rated current for four LEDs as a current limit value.

As described above, the microcomputer 900 detects the open fault of the LED, takes the drive current supplied before the fault and the rated current of the LEDs into consideration, and controls the drive current capable of providing optimum luminance to be reset.

Next, the setting of the drive current If upon the activation in Step S1 is described. When fault information indicating that an open fault occurs in one of the LEDs belonging to the LED group A or in one of the LEDs belonging to the LED group B is stored in the memory 800, the microcomputer 900 sets a drive current If as a current limit value of 24 A. When fault information indicating that open faults occur in one of the LEDs belonging to the LED group A and in one of the LEDs belonging to the LED group B is stored in the memory 800, the microcomputer 900 sets a drive current If as a current limit value of 16 A.

When fault information indicating that open faults occur in two of the LEDs belonging to the LED group A or in two of the LEDs belonging to the LED group B is stored in the memory 800, the microcomputer 900 sets a drive current If as a current limit value of 8 A. In this manner, the drive current If is set as the current limit value upon the activation on the basis of the fault information stored in the memory 800, whereby the drive current If of the LEDs can be controlled so as not to exceed the maximum rated current of the LEDs upon the activation.

As described above, the light source control device according to this preferred embodiment includes the constant-current circuit 100 that collectively supplies a current to the plurality of LEDs 111, 112, 113, 114, the current detection circuits 131, 132 that divide the plurality of LEDs 111, 112, 113, 114 into groups and detect a current amount of a current supplied to each of the groups, and the microcomputer 900 that detects an open fault in the LEDs on the basis of a ratio of the current amount in each of the groups and controls a current supplied from the constant-current circuit 100 to be reduced in a case where an open fault is detected in the LEDs.

Therefore, a fault in the LEDs due to an open fault can be detected, and an excessive current can be prevented from flowing to the other normal LEDs in which no fault occurs.

Moreover, the current detection circuits can be reduced by detecting a current amount in each of the LED groups without individually detecting a current of the LEDs 111, 112, 113, 114.

In addition, even when an open fault occurs in one or more of the LEDs, a drive current for appropriate luminance can be supplied to the other normal LEDs, so that the light sources in the optimum luminance can be provided to a user.

Furthermore, fault information detected by the microcomputer 900 is transmitted, for display, to a control personal computer that controls the light source control device or a liquid crystal display device, whereby the user can be notified of a fault state of the LED, namely, a need to replace the LED. Urging the user to replace the LED in which the fault occurs allows for restoration of the light source display device before a fault occurs in all of the LEDs.

The light source control device further includes the memory 800 that, in a case the microcomputer 900 serving as the fault detector detects the open fault in the LEDs, stores the fault information indicating the LED in which the open fault is detected. Upon the activation, the microcomputer 900 sets, as a current limit value, a current amount of a drive current If supplied from the constant-current circuit 100 on the basis of the fault information stored in the memory 800 such that a current supplied to each of the LEDs is a maximum rated current or less. Therefore, the drive current If of the LEDs can be controlled so as not to exceed the maximum rated current of the LEDs upon the activation.

In addition, upon the activation, the microcomputer 900 may set, as a current limit value, a current amount of a drive current If supplied from the constant-current circuit 100 on the basis of the fault information stored in the memory 800 such that a current supplied to each of the LEDs is a maximum allowable current or less. In this case, the drive current If of the LEDs can be controlled so as not to exceed the maximum allowable current of the LEDs upon the activation.

The microcomputer 900 determines that the fault information about the LED in which the open fault has been detected is invalid when the LED is replaced. Thus, the setting of the current limit value is cleared, and the entire luminance of the LEDs can be increased.

In this preferred embodiment, as an example of the aggregation of the plurality of the LEDs, it is described that the four LEDs 111, 112, 113, 114 are divided into the LED group A to which the two LEDs 111, 112 belong and the LED group B to which the two LEDs 113, 114, but this is not restrictive. A configuration that divides a plurality of LEDs into groups by one constant-current circuit and controls them as one light source can obtain the similar effects.

In this preferred embodiment, it is described that the four LEDs 111, 112, 113, 114 have the same characteristics, but the microcomputer 900 may make a determination by taking characteristics and variations in circuits into consideration. The microcomputer 900 may determine, for example, that a current ratio is regarded as 1:2 when a current ratio of the LED groups A, B is in a range of 0.9:2.2 to 1.1:1.8, and a current ratio is regarded as 1:1 when a current ratio is in a range of 0.9:1.1 to 1.1:0.9, and a current of 0.2 A or less is regarded as 0 A.

In this preferred embodiment, it is described that the microcomputer 900 stores the fault information of the LED, the occurrence time of the fault, the replacement information of the LED, and the replacement time of the LED in the memory 800, but the similar effects can be obtained by providing a means of invalidating the fault information of the LED upon the replacement of the LED without storing the occurrence time and the replacement time.

In this preferred embodiment, the light source control device including the LEDs as the light sources is described, but this is not restrictive. The similar effects can be obtained when the other semiconductor light sources, such as lasers, are used.

In this preferred embodiment, the current detection circuits are each provided in the LED groups A, B, but the current detection circuits and the AD converter serve as one circuit to switch outputs of the detection resistors each provided in the LED groups A, B and to input one of the outputs to the current detection circuits and the AD converter, which may be a configuration of a circuit that detects current of LEDs and be a control method.

The specifications and the characteristics of the current detection circuits and the AD converter described in this preferred embodiment are only an example, so that this is not restrictive as long as the similar effects can be obtained. Moreover, the conversion table shown in FIG. 3 on the basis of the specifications and the characteristics of the current detection circuits and the AD converter is only an example, so that this is not restrictive as long as the similar effects can be obtained.

The present invention may be realized as a light source control method that includes operations of characteristic structural portions included in the light source control device as steps. The present invention may be realized as a program that performs each of the steps included in the light source control method on a computer. The present invention may be realized as a recording medium capable of reading the computer that stores the program. The program may be distributed via a transmission medium such as the Internet.

All of the numeric values used in this preferred embodiment are examples for specifically describing the present invention. In other words, the present invention is not limited to each of the numeric values used in the preferred embodiment above.

The light source control method according to the present invention corresponds to part of or all of the processes in FIGS. 4 and 5. All of the corresponding steps in FIGS. 4 and 5 do not always need to be included. In other words, it suffices that the light source control method according to the present invention includes only the minimum steps for achieving the effects of the present invention. For example, the light source control method according to the present invention may be a method without Step S5 and Step S12.

The order of performing each of the steps in the light source control method is an example to specifically describe the present invention, and it may be an order except for the order mentioned above. Moreover, part of the steps in the light source control method and the other steps may be performed independently of each other and in parallel to each other.

Additionally, part of each structural component in the light source control device may be realized as a large scale integration (LSI) typically being an integrated circuit. For example, the microcomputer 900 and the current detection circuits 131, 132 may be realized as integrated circuits.

In addition, according to the present invention, preferred embodiments can be appropriately varied or omitted within the scope of the invention.

While the invention has been shown and described in detail, the foregoing description is in all aspects illustrative and not restrictive. It is therefore understood that numerous modifications and variations can be devised without departing from the scope of the invention.

What is claimed is:

1. A light source control device that controls a plurality of light sources connected in parallel, said device comprising:

a constant current supply unit that collectively supplies a constant current to said plurality of light sources;

a plurality of current detection circuits, each current detection circuit serially connected to two or more of the plurality of light sources such that the plurality of current detection circuits divide said plurality of light sources into light source groups and detect a current amount of a current supplied to each of said light source groups, each light source group having at least two light sources connected in parallel; and a controller configured to detect an open fault in a light source group on the basis of a ratio of the detected current amount in each of said light source groups; and control a current supplied from said constant current supply unit to be reduced in a case where the open fault in one of said light source groups is detected.

2. The light source control device according to claim 1, further comprising:

a storage unit that, in a case where said controller detects the open fault in said light sources, stores fault information indicating the light source in which the open fault is detected, wherein upon activation, said controller sets, as a current limit value, a current amount of a current supplied from said constant current supply unit on the basis of said fault information stored in said storage unit such that a current supplied to each of said light sources is a maximum allowable current or less.

3. The light source control device according to claim 2, wherein said controller determines that, in a case where the light source in which an open fault has been detected is replaced, said fault information about the light source is invalid.

4. A light source control method performed by a light source control device that comprises a constant current supply unit collectively supplying a constant current to a plurality of light sources connected in parallel and controls said plurality of light sources, said method comprising:

dividing said plurality of light sources into light source groups by serially connecting a current detection circuit to two or more of the plurality of light sources and detecting a current amount of a current supplied to each of said light source groups, each light source group having at least two light sources connected in parallel;

detecting, using a controller, an open fault in a light source group on the basis of a ratio of said current amount in each of said light source groups; and controlling, using the controller, a current supplied from said constant current supply unit to be reduced in a case where the open fault is detected in said light sources.

5. The light source control device according to claim 1, wherein each current detection circuit outputs a current detection signal at voltage levels corresponding to the detected current amount.

* * * * *